US006334564B1

(12) United States Patent
Kishine et al.

(10) Patent No.: US 6,334,564 B1
(45) Date of Patent: Jan. 1, 2002

(54) INFEED SYSTEM OF ROTARY PRESS

(75) Inventors: Toshiaki Kishine; Akira Ishikawa; Takashi Ito, all of Chiba (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 0 days.

(21) Appl. No.: 09/551,666

(22) Filed: Apr. 18, 2000

(30) Foreign Application Priority Data

Jun. 29, 1999 (JP) ..... 11-183500

(51) Int. Cl.[7] ..... B65H 23/18
(52) U.S. Cl. ..... 226/42; 242/418.1
(58) Field of Search ..... 226/24, 40, 42; 242/564.4, 418.1

(56) References Cited

U.S. PATENT DOCUMENTS 3,177,749 A * 4/1965 Best et al. ..... 226/42 X
3,326,436 A * 6/1967 Huck ..... 226/25
3,539,085 A * 11/1970 Anderson ..... 226/42 X
3,561,654 A * 2/1971 Greiner ..... 226/40 X
3,713,606 A * 1/1973 Van Pelt et al. ..... 226/42 X
4,057,185 A * 11/1977 Slama et al. ..... 226/42 X
5,707,024 A * 1/1998 Mellquist et al. ..... 242/418.1
5,709,331 A * 1/1998 Lam et al. ..... 226/42 X
5,860,579 A * 1/1999 Akira et al. ..... 226/42 X
6,095,391 A * 8/2000 Fiske et al. ..... 226/42

FOREIGN PATENT DOCUMENTS

JP 4-51456 8/1992

* cited by examiner

*Primary Examiner*—Michael R. Mansen
(74) *Attorney, Agent, or Firm*—Frishauf, Holtz, Goodman, Langer & Chick, P.C.

(57) ABSTRACT

In a rotary press, a traveling amount of a paper web is controlled by an infeed system including infeed rolls which feed the paper web to a subsequent stage for an operation such as a printing process. The infeed system of the rotary press includes a traveling amount measuring device disposed on a traveling line of the paper web fed by the infeed rolls for measuring the traveling amount of the paper web in a tension free state and for generating a signal representing the measured result, and a traveling amount controlling device for controlling the traveling amount of the paper web fed by the infeed rolls in response to the signal from the traveling amount measuring device.

3 Claims, 3 Drawing Sheets

PRIOR ART

PRIOR ART

INFEED SYSTEM OF ROTARY PRESS

BACKGROUND OF THE INVENTION

The present invention relates to an infeed system of a rotary press in which a paper web of a web roll supported by a web roll supporting means of a rotary press is supplied for a succeeding process such as a printing process in a printing section by means of infeed roll by which a paper web traveling amount can be controlled.

In a case where a plurality of paper webs printed by a rotary press are gathered or collated by a collator, it is required for the paper webs to have the same top and bottom dimensions with each other. Particularly, for a business-form rotary press carrying out printings on paper webs which are required to be gathered or collated by the collator after printings, it is very important for the paper webs to have constant top and bottom dimensions with each other even if materials, basis weights thickness or the like of paper webs to be collated are different from each other.

However, as is known, where the paper webs are fed by an infeed system of the rotary press, the traveling amounts thereof differ from each other in accordance with the materials, basis weights thickness or the like of the paper webs. Accordingly, in a case where such various different kinds of paper webs are printed, the traveling amounts differ from each other even if the paper webs are printed under the same printing conditions, hence providing inconvenience at the time when paper webs are gathered or collated.

In order to eliminate such defects, a first prior art providing a solution is disclosed for example, in Japanese Patent Publication No. HEI 4-51456. This prior art discloses a structure, as shown in FIG. 2, comprising a plate cylinder 1, a blanket (rubber) cylinder 2, an impression cylinder 3, and a differential speed change gear 5 disposed in a power transmission means for the blanket cylinder 2 and the impression cylinder 3 which put a paper web between them, carry out printing on the paper web and make the same travel. The differential speed changer 5 comprises a Harmonic Drive (Trade Name) a speed of which is adjustable by an adjustment motor 4. In this structure, the plate cylinder 1, the blanket cylinder 2 and the impression cylinder 3 are coupled in series to each other and rotated at the same rotation number in directions reverse to each other.

According to this first prior art, the rotating speed of the impression cylinder 3 is adjusted by the differential speed change gear 5 with respect to the rotating speed of the blanket cylinder 2 thereby to change the traveling amount of the paper web. That is, in a case of thick paper web, the rotating speed of the impression cylinder 3 is decreased, and on the other hand, in a case of thin paper web, the impression cylinder 3 is adjusted reversely. In this manner, the traveling amount of the paper web can be changed.

A second prior art also provides a solution, in which the rotating speed of the infeed roll is adjusted in accordance with the change of the tensions in consideration that tensions of paper webs passing between rolls are changed in accordance with the change of the paper web thickness.

FIG. 3 is a schematic view showing the structure of the above second prior art. With reference to FIG. 3, a paper web 7 fed from a web roll 7*a* is fed in the paper web traveling direction and wound up in substantially S-shape around two infeed rolls 8*a* and 8*b*, which are rotated in directions reverse to each other at the same rotating speed, and the paper web 7 is then supplied on a side of the printing unit 9, i.e. downstream side, in the paper web traveling direction.

The infeed rolls 8*a*, 8*b* and the printing unit 9 are driven by a drive line 10 from a press machine side through gear boxes 11*a* and 11*a*, respectively. In the gear box 11*a* driving the infeed rolls 8*a* and 8*b*, there is housed the differential speed change gear 5 having the speed ratio (gear ratio) which is adjustable by the adjusting motor 4 as like as in the first prior art mentioned above. Further, first and second tension detectors 12*a* and 12*b* for detecting the tension of the paper web 7 are arranged on both the upstream side and downstream side of the infeed rolls 8*a* and 8*b*, respectively.

In FIG. 3, reference numeral 13 denotes a controller for generating a speed change signal to the motor 4. The controller 13 carries out a comparison operation of a detection value T1 fed back from the second tension detector 12*b* disposed downstream side of the infeed rolls 8*a* and 8*b* with a set value T2 preset by a setting device 14, and the controller 13 then generates a signal, to the motor 4, for adjusting the differential speed change gear 5 so as to rotate the infeed rolls 8*a* and 8*b* at the rotating speed at which the compared value becomes zero. Accordingly, the infeed rolls 8*a* and 8*b* are controlled so that the tension T1 of the paper web 7 detected by the second tension detector 12*b* always becomes equal to the set value T2 set by the setting device 14 thereby to keep constant the traveling amount of the paper web 7. Further, reference numeral 15 denotes a brake means operating in response to the detection value detected by the first tension detector 12*a*.

Further, it is to be noted that the term "traveling amount" used herein means a traveling distance (length) per unit rotation number of a prime mover (motor) of the rotary press, a traveling distance (length) per one rotation of the infeed roll or a traveling distance (length) per unit time.

In the first prior art mentioned above, when paper webs having different thicknesses are fed by the blanket cylinder 2 and the impression cylinder 3 as the infeed rolls with the tension applied to the paper web in the paper web traveling line and being maintained constant, the traveling amount of the paper webs differ in accordance with the thicknesses of the paper webs. Because of this reason, in the prior art, in order to make constant the traveling amounts of a plurality of paper webs having different thicknesses, it is necessary to obtain an aimed (target) traveling amount of the paper web by experimentally calculating a preset value to be inputted into the adjusting motor 4 for determining the speed ratio (gear ratio) of the differential speed change gear 5 with respect to each of the paper webs, measuring an absolute value of the paper web traveling amount by means of scale and so forth, in an operation stop condition of the printer,and then amending or correcting a feed amount by the infeed roll. Accordingly, it is very difficult to make travel the plurality of paper webs having different thicknesses at the same traveling amount. Furthermore, because the wind-up diameter of the web roll is changed as the paper web is fed, it is sometimes necessary to check the traveling amount at an intermediate time of the feeding as well as the feed-start time according to the condition of the web. In such case, some problems were caused on the printing process.

On the other hand, in the second prior art mentioned above, the detection value T1 and the set value T2 are compared by the controller 13, and the signal for operating the adjustment motor 4 to adjust the motor rotating speed so as to make zero the compared value is generated to the motor 4. According to this operation, the tension of the paper webs having different thicknesses at the traveling time can be made constant and the traveling speed of the paper webs can be hence maintained constant.

However, the detection value T1 inputted into the controller 13 is a value of the tension, which is a predetermined tension applied to the paper web 7, and therefore, this value T1 is the value detected at time when the paper web is elastically and plastically deformed by the tension. Accordingly, even if the detection value T1 is the same with respect to the different paper webs, the actual traveling amounts of the paper webs having different thicknesses and different elastic deformations due to the thickness difference, become different from each other. Thus, the correction or amendment of this matter is very troublesome to be handled.

In an actual operation, in order to obtain a precise traveling amount of the paper web, it is necessary to actually measure the absolute value of the paper web traveling amount by means of a scale or the like after once stopping the feeding of the paper web and then to correct and preset the set value T2 of the tension in conformity with the measurement result of the absolute value of the traveling amount. These workings are made in accordance with the experience of the workers, requiring the skill and, hence, being troublesome and inconvenient. That is, in such a prior art, it is difficult to carry out the presetting of the fundamental traveling amount.

SUMMARY OF THE INVENTION

An object of the present invention is to substantially eliminate defects or drawbacks encountered in the prior art mentioned above and to provide an infeed system of a rotary press capable of accurately measuring an absolute value of traveling amount of a paper web regardless of material, basis weight (thickness) or the like of the paper web, always maintaining the traveling amount thereof to an aimed (target) traveling amount and making constant the traveling amount of the paper web in conformity with gathering or collating operation of a collator.

This and other objects of the present invention can be achieved by providing, in one aspect, an infeed system of a rotary press in which a traveling amount of a paper web is controlled by infeed rolls which feed the paper web to a subsequent process, said system comprising:

traveling amount measuring means disposed on a traveling line of the paper web fed by the infeed rolls for measuring the traveling amount of the paper web in a tension free state that is created between the infeed rolls by rotating the infeed rolls in a same direction and at a same speed, and for generating a signal representing the measured traveling amount; and traveling amount controlling means for controlling the traveling amount of the paper web fed by the infeed rolls in response to the signal generated by the traveling amount measuring means.

In a more concrete aspect, there is provided an infeed system of a rotary press for controlling a traveling amount of a paper web fed from a web roll, comprising:

at least first and second infeed rolls disposed on a downstream side of the web roll for feeding the paper web in a traveling direction in a tension free state that is created between the first and second infeed rolls by rotating the infeed rolls in a same direction and at a same speed;

infeed roll driving means for driving the first and second infeed rolls, said infeed roll driving means including infeed roll rotation speed adjusting means for adjusting the rotation speed of said infeed rolls, respectively;

traveling amount detection means for detecting the traveling amount of the paper web and for generating a signal representing the detected traveling amount;

rotation speed detection means for detecting the rotation speed of the infeed rolls and for generating a signal representing the detected rotation speed; and control means operatively connected to said infeed roll driving means for controlling the traveling amount of the paper web in accordance with the signals generated by the traveling amount detection means and the rotation speed detection means.

In a more specific embodiment, the infeed system further comprises a third infeed roll disposed on a downstream side of the second infeed roll to be rotatable in a direction reverse to that of the second infeed roll.

According to the infeed system of the rotary press of the present invention mentioned above, the amount of traveling the paper web from the web (roll) to the subsequent stage or process such as printing process is measured under the no-tension (tension free) state on the paper web traveling line by the traveling amount detector, and accordingly, the traveling amount measured under this state can be measured as an absolute value with no relation to the material of the paper web and the basis weight thickness thereof. The thus measured value is compared with the target traveling amount thereby to control the traveling amount of the paper web of the infeed rolls by the control means.

The traveling amount of the paper web by means of infeed rolls can be mechanically controlled in accordance with the traveling amount of the paper web under the tension free state, and accordingly, in a case where paper webs different in their materials, basis weights or thicknesses and the like are fed, the traveling amount of the paper webs can be always maintained substantially to the target traveling amount and the collation by the collator can be made properly constant.

Furthermore, it is not necessary to carry out the measurement or correction of the traveling amount by stopping the operation of a machine at every time when a different paper web is used, thus eliminating loss of working time, being convenient and advantageous.

The nature and further characteristic features of the present invention will be made more clear from the following descriptions made with reference to the accompanying drawings.

DESCRIPTION OF THE PREFERRED EMBODIMENT

Figure 1:
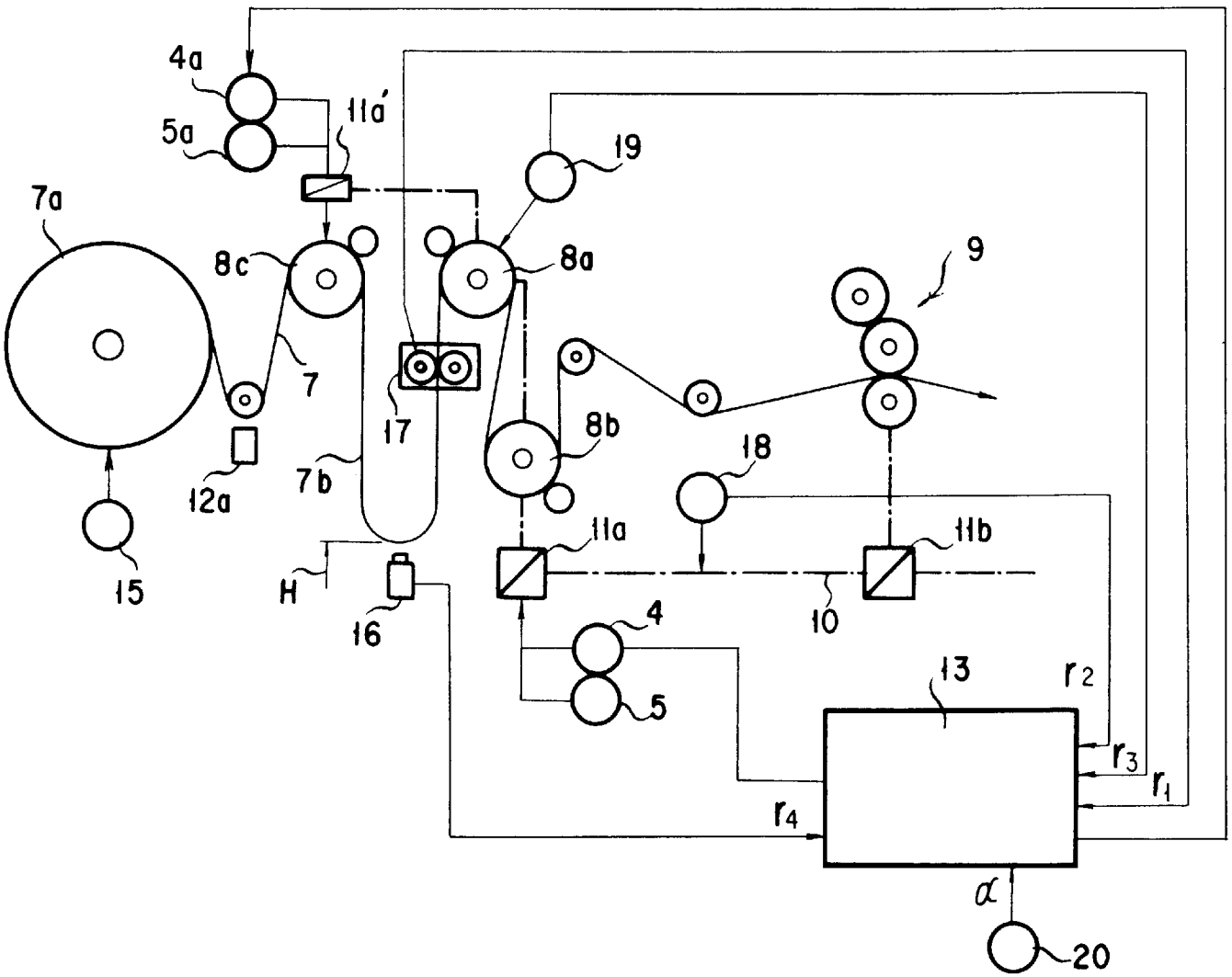
FIG. 1 is a schematic diagram showing a structure and arrangement of an infeed system of a rotary press according to one embodiment of the present invention.
Figure 2:
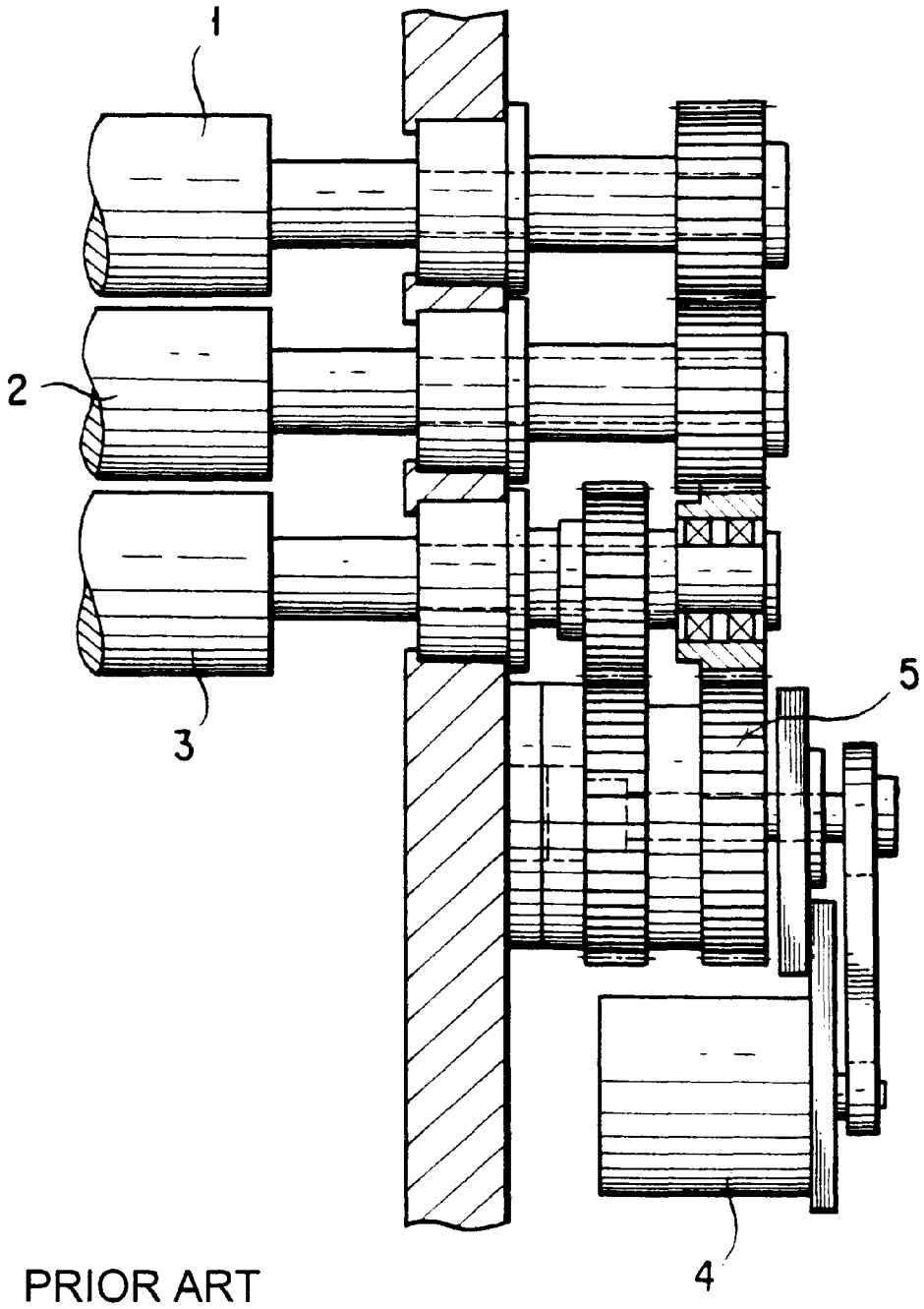
FIG. 2 is a schematic sectional view of one conventional structure of an infeed system of a rotary press.
Figure 3:
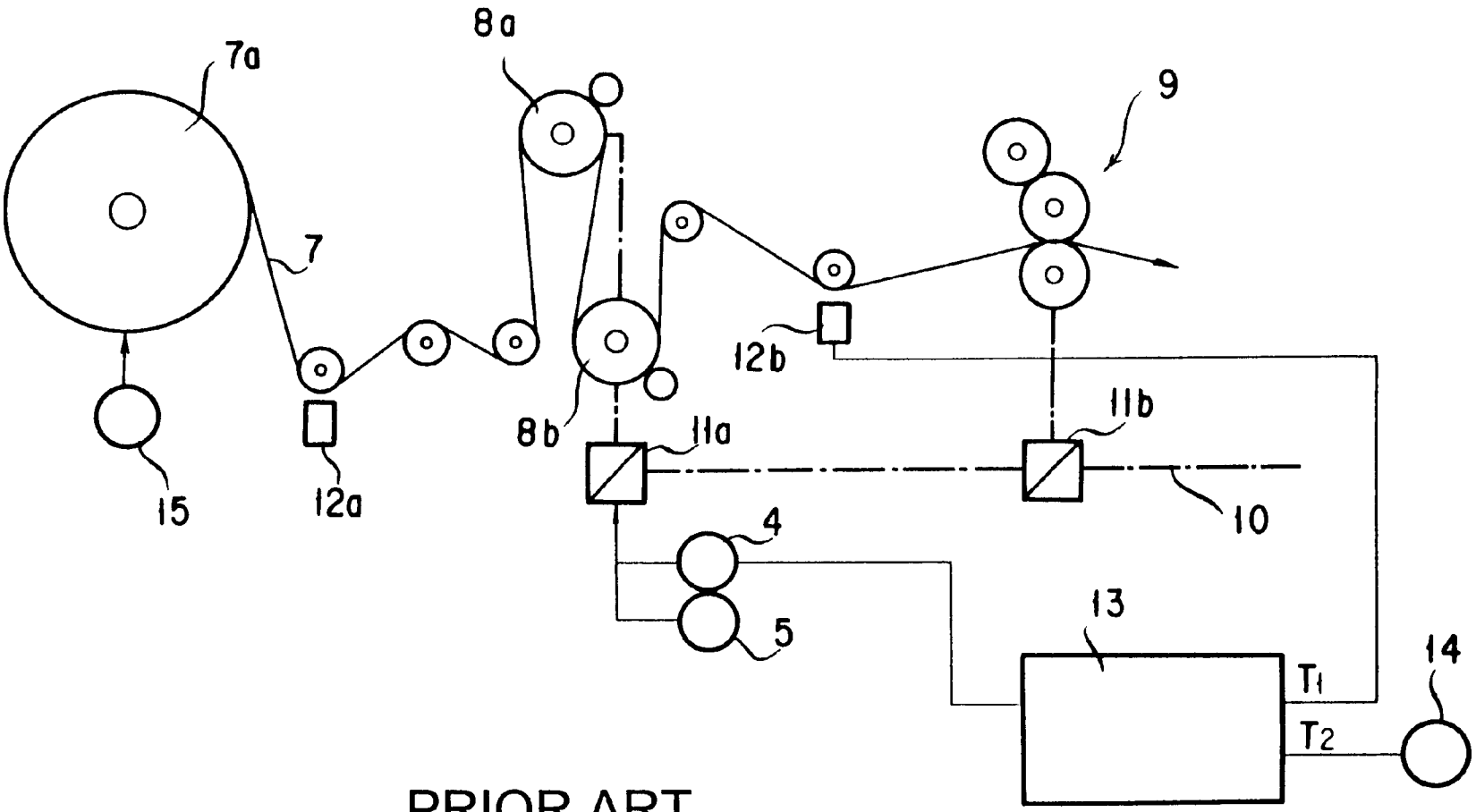
FIG. 3 is a schematic diagram showing another conventional structure of an infeed system of a rotary press.

One preferred embodiment of the present invention will be described hereunder with reference to FIG. 1, in which the same reference numerals used in FIGS. 2 and 3 are added to corresponding elements or arrangements, respectively.

With reference to FIG. 1, in addition to the first and second infeed rolls 8*a* and 8*b* in the conventional arrangement, a third infeed roll 8*c* is arranged. This third infeed roll 8*c* is positioned on the upstream side of the paper web feed direction of the infeed rolls 8*a* and 8*b* at a position separated by a predetermined distance from the first infeed roll 8*a* in the traveling direction of the paper web 7 so as to be rotatable in the same direction of the first infeed roll 8*a*.

The third infeed roll 8*c* is operatively connected to the first gear box 11*a*, which is the driving source common to that of the first and second infeed rolls 8*a* and 8*b*, through a transmission mechanism having the same speed ratio (gear ratio) as that of the infeed rolls 8*a* and 8*b*. A rotation speed of an output side of the first gear box 11*a* is made optionally adjustable by means of the differential speed change gear 5 having the rotational speed which is adjustable by the motor 4 as in the second prior art mentioned hereinbefore.

Furthermore, in the transmission mechanism connecting the third infeed roll 8*c* and the first gear box 11*a*, another gear box 11*a*' which houses another differential speed change gear 5*a* having a rotational speed adjustable by another adjusting motor 4*a* connected to the controller 13 are incorporated so that the rotating speed of the third infeed roll 8*c* can be solely adjusted independently of the first and second infeed rolls 8*a* and 8*b*.

A paper web detector 16, such as ultrasonic sensor, for detecting the traveling paper web 7 is disposed at a position sufficiently below the portion between the first and third infeed rolls 8*a* and 8*c* which are rotatable in the same direction, the paper web detector 16 being directed upward, as viewed. And a paper web traveling amount detector 17 for detecting the traveling amount of the paper web 7 is arranged upstream side of the first infeed roll 8*a*. The paper web traveling amount detector 17 comprises, for example, a pair of rolls which are rotatable without slipping and an encoder detecting the rotational speed of these rolls.

Further, the first and second gear boxes 11*a* and 11*b* are connected with a drive line 10 on which a drive line rotation speed detector 18 is arranged, and an infeed roll rotation speed detector 19 is also arranged on one of the first and second infeed rolls 8*a* and 8*b* so as to detect the rotating speed thereof. These detectors 17, 18 and 19 are operatively connected to the controller 13 so that the detected values r1, r2 and r3 of these detectors are inputted to the controller 13.

The controller 13 is provided with a setting device 20, and information of the material, basis weight (thickness) and the like of the paper web 7 are inputted into the setting device 20 and, according to these information, there is determined an initial feed amount of the paper web 7 with respect to the target traveling amount thereof, which is then inputted into the controller 13 as the initially set feed amount α.

In the structure mentioned above, the paper web 7 taken out from the web roll 7*a* is fed to the printing unit 9 side through the third, first and second infeed rolls 8*c*, 8*a* and 8*b*, which are arranged in this order from upstream side to the downstream side of the paper web traveling direction. The paper web 7 of the web roll 7*a* is taken out by the third infeed roll 8*c* disposed most upstream side.

In this paper web feeding process, the above three infeed rolls 8*c*, 8*a* and 8*b* are rotated at the same speed by means of the drive line 10 and the gear box 11*a*. The rotation speed of the rolls at this time is controlled by the differential speed change gear 5 which is adjusted by the adjusting motor 4 thereby to finely adjust the traveling amount of the paper web 7.

As mentioned above, in this paper web feeding process, since the third roll 8*c* and the first roll 8*a* are rotated at the same speed, no tension is applied to the paper web 7 (tension free state) between these rolls 8*c* and 8*a*, so that a loop portion 7*b* of the paper web 7 suspended downward is formed between these rolls 8*c* and 8*a* as shown in FIG. 1. Then, the paper web 7 in this loop portion 7*b* is passed through the traveling amount detector 17. The paper web 7 passing through the traveling amount detector 17 is pulled by the first infeed roll 8*a* disposed downstream side of the third infeed roll 8*c*, and then, the roller of the traveling amount detector 17 is rotated thereby to detect the traveling amount of the paper web portion to which no tension is applied (no-tension or tension free portion). The thus detected signal r1 is inputted into the controller 13.

With reference to FIG. 1, a height H, as viewed, of the loop portion 7*b* of the paper web 7 between the rolls 8*c* and 8*a* is detected by the paper web detector 16, and the detected value (signal) r4 is inputted into the controller 13. The height H of the loop portion 7*b* is changed in response to the rotation speed of the third infeed roll 8*c* arranged upstream side the loop portion 7*b*. Further, since it is desired for the height H of the loop portion 7*b* to be always constant, this height H is adjustable to be always constant by finely adjusting the rotation speed of the third infeed roll 8*c* by the differential speed change gear 5*a* which is controlled by the controller 13 via the adjusting motor 4*a* of in response to the signal corresponding to the detected value r4 by the paper web detector 16.

The initially set feed amount α to the target traveling amount of the paper web 7 set in accordance with the paper web material, basis weight (thickness) and the like of the paper web 7 is preset in the controller 13 by means of the setting device 20. Then, the controller 13 operates to compare the initially set feed amount α with the traveling amount of the loop portion of the paper web 7 calculated from the detection signal r3 from the infeed roll rotation speed detector 19, to calculate a differential feed amount between the traveling amount of the paper web and the initially set feed amount α, that is, a feed amount for converting the traveling amount, and then to generate a correction signal for correcting the traveling amount of the paper web 7 so as the differential feed amount becomes zero to the adjusting motor 4 of the gear box 11*a*. This correction signal is generated until the traveling amount of the loop portion 7*b* of the paper web 7 accords with the initially set feed amount α. After the completion of the initial setting, the transmission of the correction signal of the first gear box 11*a* from the controller 13 to the adjusting motor 4 is stop.

As mentioned above, by presetting the initially set feed amount α, the traveling amount of the paper web nearly the target traveling amount can be obtained at the initial stage, and hence, an amount of the wastepaper web generating at the operation starting time can be substantially reduced.

In the next step, the target traveling amount calculated from the signal r2 of the driving line rotation speed detector 18 and the absolute value of the traveling amount measured by the traveling amount detector 17 are compared by the controller 13 thereby to calculate a differential feed amount between the traveling amount and the target traveling amount. Then, the correction signal for correcting the traveling amount is of the paper web 7 so as to the differential feed amount becomes zero is outputted to the adjusting motor 4 of the first gear box 11*a*.

That is, in the case where the traveling amount of the paper web 7 by means of the infeed rolls 8*a*, 8*b* and 8*c* is greater than the target traveling amount, a signal for decreasing (reducing) the paper web traveling amount is outputted to the adjusting motor 4, and on the other hand, in the case where the traveling amount of the paper web 7 by means of the infeed rolls 8*a*, 8*b* and 8*c* is smaller than the target traveling amount, a signal for increasing the paper web traveling amount is outputted to the adjusting motor 4, thus maintaining the paper web traveling amount always constant to the target traveling amount.

The tension of the paper web 7 fed from the web 7*a* is detected by the tension detector 12*a* disposed at the predetermined position, and in response to the detected value, the operation of the brake 15 is adjusted.

It is to be noted that the present invention is not limited to the described embodiment and many other changes and modifications may be made without departing from the scopes of the appended claims.

For example, the traveling amount detector 17, mentioned above, comprising a pair of rolls and an encoder may be substituted with a non-contact type detector. Moreover, in order to create no tension to the paper web 7, at least two infeed rolls may be required, and in this meaning, the most downstream side infeed roll 8*b* may be eliminated.

Although the present invention has been hereinbefore described very specifically and as adapted for a rotary printing press, it is not desired that the invention is limited by the exact details of this disclosure. A variety of modifications and alterations of the illustrated embodiments may be made in order to conform to design preferences or to the requirements of each specific application, without departing from the proper scope or fair meaning of the claims which follows.

What is claimed is:

1. An infeed system of a rotary press in which a traveling amount of a paper web is controlled by infeed rolls which feed the paper web to a subsequent process, said system comprising:

traveling amount measuring means disposed on a traveling line of the paper web fed by the infeed rolls for measuring the traveling amount of the paper web in a tension free state that is created between the infeed rolls by rotating the infeed rolls in a same direction and at a same speed, and for generating a signal representing the measured traveling amount; and traveling amount controlling means for controlling the traveling amount of the paper web fed by the infeed rolls in response to the signal generated by the traveling amount measuring means.

2. An infeed system of a rotary press for controlling a traveling amount of a paper web fed from a web roll, comprising:

at least first and second infeed rolls disposed on a downstream side of the web roll for feeding the paper web in a traveling direction in a tension free state that is created between the first and second infeed rolls by rotating the infeed rolls in a same direction and at a same speed;

infeed roll driving means for driving the first and second infeed rolls, said infeed roll driving means including infeed roll rotation speed adjusting means for adjusting the rotation speed of said infeed rolls, respectively;

traveling amount detection means for detecting the traveling amount of the paper web between the at least first and second infeed rolls and for generating a signal representing the detected traveling amount;

rotation speed detection means for detecting the rotation speed of the infeed rolls and for generating a signal representing the detected rotation speed; and control means operatively connected to said infeed roll driving means for controlling the traveling amount of the paper web in accordance with the signals generated by the traveling amount detection means and the rotation speed detection means.

3. An infeed system of a rotary press according to claim 2, further comprising a third infeed roll disposed on a downstream side of the second infeed roll to be rotatable in a direction reverse to that of the second infeed roll.

* * * * *